US005934638A

United States Patent [19]

Provot

[11] Patent Number: 5,934,638

[45] Date of Patent: Aug. 10, 1999

[54] HOLLOW SKID

[75] Inventor: Jean Michel Provot, Saint Avold, France

[73] Assignee: Perstorp AB, Sweden

[21] Appl. No.: 08/727,394

[22] PCT Filed: Mar. 31, 1995

[86] PCT No.: PCT/SE95/00351

§ 371 Date: Nov. 20, 1996

§ 102(e) Date: Nov. 20, 1996

[87] PCT Pub. No.: WO95/28330

PCT Pub. Date: Oct. 26, 1995

[30] Foreign Application Priority Data

Apr. 13, 1994 [SE] Sweden ..... 9401237

[51] Int. Cl.[6] ..... A47B 91/00

[52] U.S. Cl. ..... 248/346.02; 248/346.01; 108/55.1

[58] Field of Search ..... 248/176.01, 346.01, 248/346.02; 108/51.1, 901, 56.1, 55.1, 53.3, 902

[56] References Cited

U.S. PATENT DOCUMENTS

| | | | |
|---|---|---|---|
| 1,658,456 | 2/1928 | Meyer | 248/346.01 |
| 3,976,013 | 8/1976 | Woodford | 108/55.1 |
| 4,185,565 | 1/1980 | Nymoen | 108/51.3 |
| 4,838,178 | 6/1989 | Chriske et al. | 108/55.1 |
| 5,492,069 | 2/1996 | Alexander | 108/56.3 |
| 5,579,701 | 12/1996 | Wah | 108/56.1 |
| 5,592,885 | 1/1997 | Young | 108/51.3 |
| 5,603,258 | 2/1997 | Besaw | 108/51.3 |
| 5,687,652 | 11/1997 | Ruma | 108/561 |

*Primary Examiner*—Ramon O. Ramirez
*Assistant Examiner*—Gwendolyn Baxter
*Attorney, Agent, or Firm*—Scully, Scott, Murphy & Presser

[57] ABSTRACT

A skid for a load carrying article, such as a pallet or a container pallet. The skid has at least two hollow profiles made of a polymeric material by injection molding using a gas injection procedure. Each hollow profile has two or more longitudinal substantially closed hollow chambers. The hollow chambers are separated from each other and enveloped by one or more defining walls. All portions of the walls are of an essentially even material thickness and where respective upper portions of the walls form an upper horizontal surface at which each hollow profile is attached to the article.

10 Claims, 3 Drawing Sheets

HOLLOW SKID

BACKGROUND OF THE INVENTION

1. Field of the Invention

The present invention relates to an improved concept for a skid made of a polymeric material and consisting of a hollow profile. The skid is intended to be used with or constitute a part of a pallet, a container pallet or the like which preferably is made of a polymeric material and which is intended for transport and/or storage of goods.

2. Discussion of the Prior Art

A pallet or the like must, to be possible to convey on ball tracks or the like, downwards be provided with skids in order to eliminate the risk that it jams in for instance the ball track. Pallets or the like provided with skids, wherein the skids and preferably also the pallet are made of a polymeric material by injection moulding are disclosed in a large amount and with varying designs and functions. A skid can sometimes be for instance a solid profile formed as a lath or edging or be a hollow profile comprising a preferably closed longitudinal chamber. A hollow profile exhibits advantages such as being material saving and chock dampening, but known concepts comprising a single hollow chamber exhibit disadvantages such as reduced stability and/or reduced carrying capacity, for instance due to the resulting design of the longitudinal chamber. A disproportional ratio between the width and the height of the chamber renders the upper central area of the skid a tendency to bend downwards or inwards when charged. Furthermore, the material thickness of the chamber walls tends to be uneven. The difference in wall thickness between respective long and short sides of the skid and most of all the edges, with the weakest spots, becomes so large that strains reducing the strength, impact resistance, flexibility and stability of the polymeric material and/or resulting in a cracking, whereby the weakest spots are further weakened. The strains caused by material thickening, appears most of all at the edges and can be referred to the fact that the core temperature of the polymer after injection moulding exceeds the surface temperature to such an extent that the core shrinkage is larger than corresponding surface shrinkage. The difference in shrinkage results in a strong inner tension. Above disclosed properties give pallets provided with such polymeric skids a limited utilization.

A hollow profile is produced through injection moulding of a polymeric material using a gas injection procedure. One type of gas injection procedures involve a moulding tool having a rigid and defined moulding cavity which is entirely filled with a molten polymeric material. The moulding tool, furthermore, comprises one or more inlet channels enabling injection of gas into the core of the molten polymeric material and one or more outlet channels through which excess of molten polymeric material during injection of gas is evacuated out of the moulding cavity, whereby a substantially closed chamber constituting a hollow profile is formed. In an alternative procedure, a moulding tool with one or more variable moulding cavities, having one or more inlet channels for gas injection, is used. The moulding cavity is in this case provided with at least one movable element, which can be moved in or out, whereby the volume of the moulding cavity increases or decreases. Molten polymeric material is injected into the moulding cavity when the movable element is in such a position that the volume of the moulding cavity is decreased to a defined filling of molten polymeric material. The movable element is, in conjunction with the gas injection, moved outwards to a defined expansion of the moulding cavity, whereby a substantially closed hollow profile is formed.

Commonly used gas injection procedures and companies of origin include:

AIRMOLD—Battenfeld

AIRPRESS—Klöckner Ferromatik

CINPRES (Contr. Internal Pressure Moulding)—Pearless Cinpress

ENCORE (Engineered Nitrogen Coresystem)—Encore Systems

GAIN (Gas-assisted Injection Molding)—Detroid Plastic Molding

GASMELT—Engel

GID (Gasinnendruckverfahren)—Dynamit-Nobel

GIP (Gasinnendruckprozeß)—Demag

GIT (Gasinjektiontechnik)—Schade

SUMMARY OF THE INVENTION

Through the present invention, it has quit unexpectedly been possible to obtain a skid to a load carrying article, such as a pallet, container pallet or the like, which skid comprises hollow profiles having above advantages without exhibiting said disadvantages. The skid comprises two or more longitudinal substantially closed hollow chambers surrounded by one or more defining walls. The defining walls are independently of an essentially even material thickness and the upper part of the walls constitute an upper horizontal surface at which the skid is attached to the pallet. The skid is made of a polymeric material and is injection moulded by means of a gas injection procedure.

A more favourable ratio between width and height of a chamber and thus a more even wall thickness having no or very reduced tensions is by, in contrast to known concepts, allow the skid to comprise more than one longitudinal hollow chamber. Furthermore, the surface of the upper central area of the skid is thus more rigid without tendency to bend downwards and/or inwards when charged. Embodiments including defining walls connected to, each other by one or more joining reinforcing profiles, such as ribs, webs, girders or the like, result in a skid having a very high stability and load carrying capacity. The joining reinforcing profiles can be solid or hollow.

A pallet etc. is preferably provided with two or more skids according to embodiments of the invention, whereby the upper surface of the skid is attached to the load carrying part of the pallet by means of one or more joining solid or hollow legs or the like or whereby the skid is attached immediately to the load carrying part. Preferably, the skid constitutes a permanently attached part of the pallet, whereby the skid is applied by gluing or welding, such as chemical or ultrasonic welding. A skid can also constitute an integrated part of a pallet, whereby all parts of the pallet are produced as a unit in one single injection moulding. Alternatively, the skid can be detachable and attached by corresponding fastening means of the type pegs and holes, hooks and loops, longitudinal or transversal undercut groove and tenon, notches, rails or the like.

BRIEF DESCRIPTION OF THE DRAWINGS

The invention is further explained in conjunction with enclosed Figures, wherein.

DETAILED DESCRIPTION OF THE PREFERRED EMBODIMENTS

Figure 1:
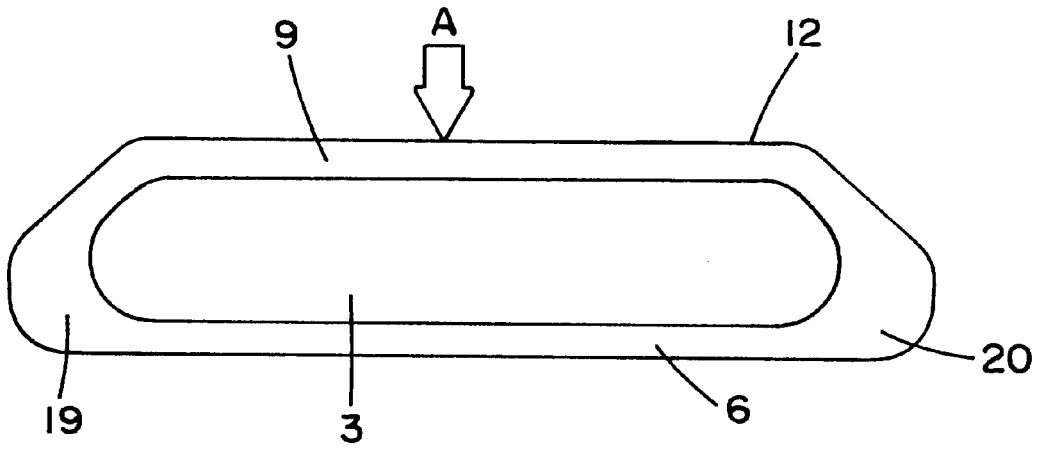
FIG. 1 (PRIOR ART)
FIG. 1 shows a crosscut of a skid according to a known concept.

FIG. 1 shows, seen from a short side, a crosscut of a skid 1 according to a known concept. The skid 1, which comprises a longitudinal essentially closed hollow profile or chamber 3 enveloped by a defining wall 6, is made of a polymeric material by injection moulding and the hollow chamber 3 is obtained by means of a gas injection procedure. Upper part 9 of the wall 6 constitutes an upper horizontal surface 12 at which the skid 1 is attached to a pallet, container pallet or the like 2 (see FIG. 5). A large and unfavourable ratio between width and height of the hollow chamber 3, and thus the skid 1, implies that its upper central area will be squeezed downwards and/or inwards when charged (indicated by arrow A). The unfavourable ratio between the width and the height of the hollow chamber 3, furthermore, results in an uneven material thickness of the wall 6 giving an increased material thickness at its two lower edges 19 and 20 being its weakest spots, whereby inner tensions give a reduced stability, impact resistance etc. and/or give rise to material cracking or checking.

Figure 2:
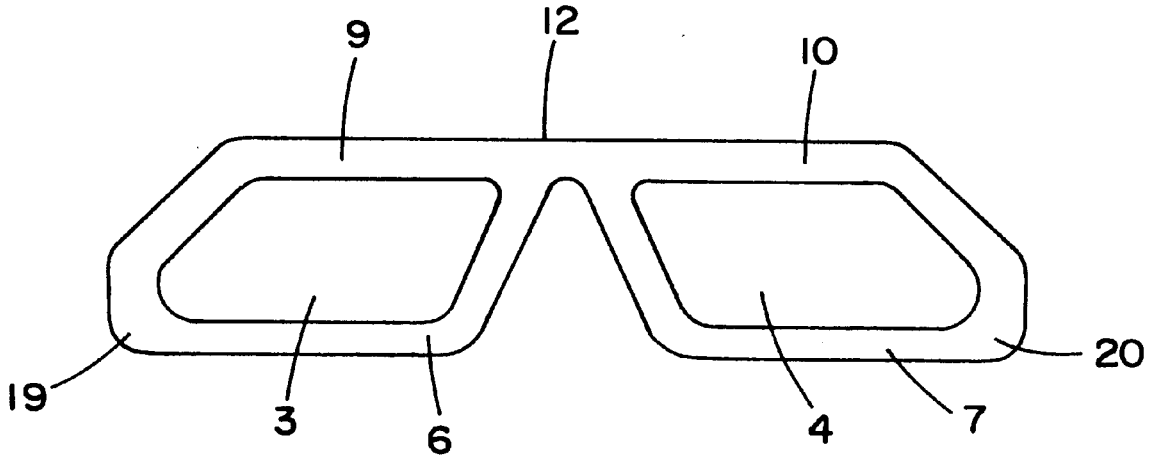
FIGS. 2–4 show sectionals of three embodiments of a skid according to the invention as taken along line 2—2 of FIG. 5.
Figure 3:
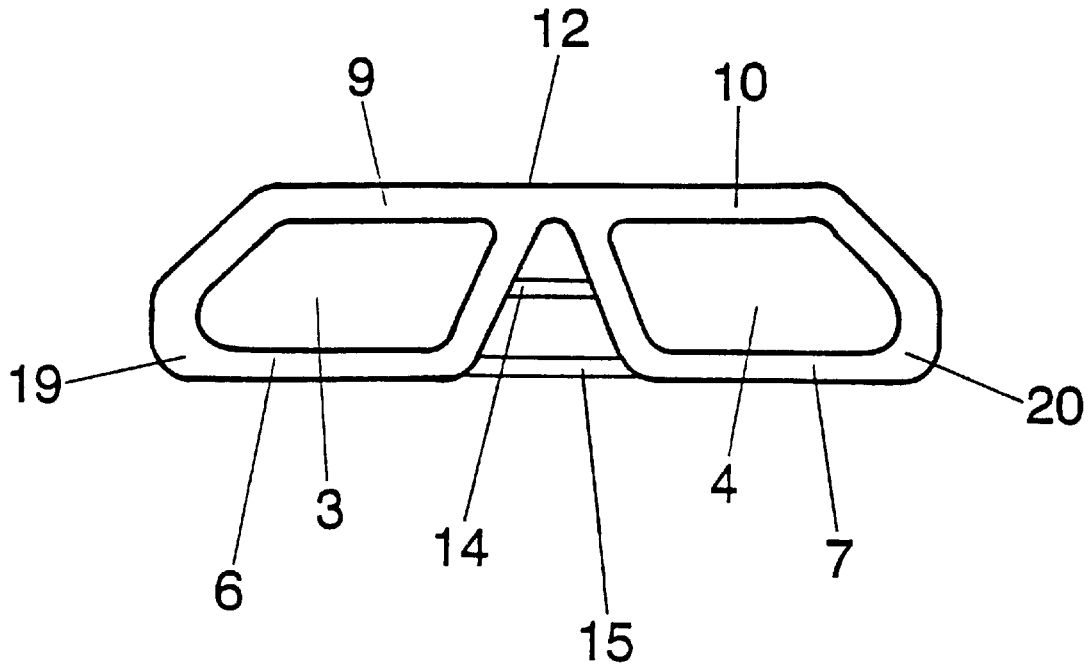

FIGS. 2 and 3 show, seen from a short side, a crosscuts of two embodiments of a skid 1 (see FIG. 5) according to the present invention. The skids of FIGS. 2 and 3 have been produced similarly to and have same basic design as the skid of FIG. 1. The two skids 1 comprise two hollow chambers 3 and 4 each giving a more favourably ratio between width and height of its hollow chambers 3 and 4. Each hollow chamber 3 and 4 are enveloped by a defining wall 6 and 7 and each upper part 9 and 10 of the walls 6 and 7 constitutes an upper horizontal surface 12 at which the skid 1 is attached to a pallet, a container pallet or similar 2 (see FIG. 5). The more favourable ratio between the width and the height of the hollow chambers 3 and 4 gives a more even material thickness of the walls 6 and 7 of the hollow chambers 3 and 4 with lesser differences in wall thickness, especially at lower edges 19 and 20, whereby inner tensions resulting in decreased stability, impact resistance etc. are avoided. A dividing into two hollow chambers 3 and 4 having separate defining walls 6 and 7, furthermore, eliminates any tendency to force the horizontal surface 12, especially its upper central area, downwards and/or inwards, when charged. The skid 1 shown in FIG. 3 is of the same embodiment as the one shown in FIG. 2 with a difference that the enveloping walls 6 and 7 between each longitudinal hollow chamber 3 and 4 are connected by two reinforcing bars 14 and 15 providing a further increased stability to the skid 1.

Figure 4:
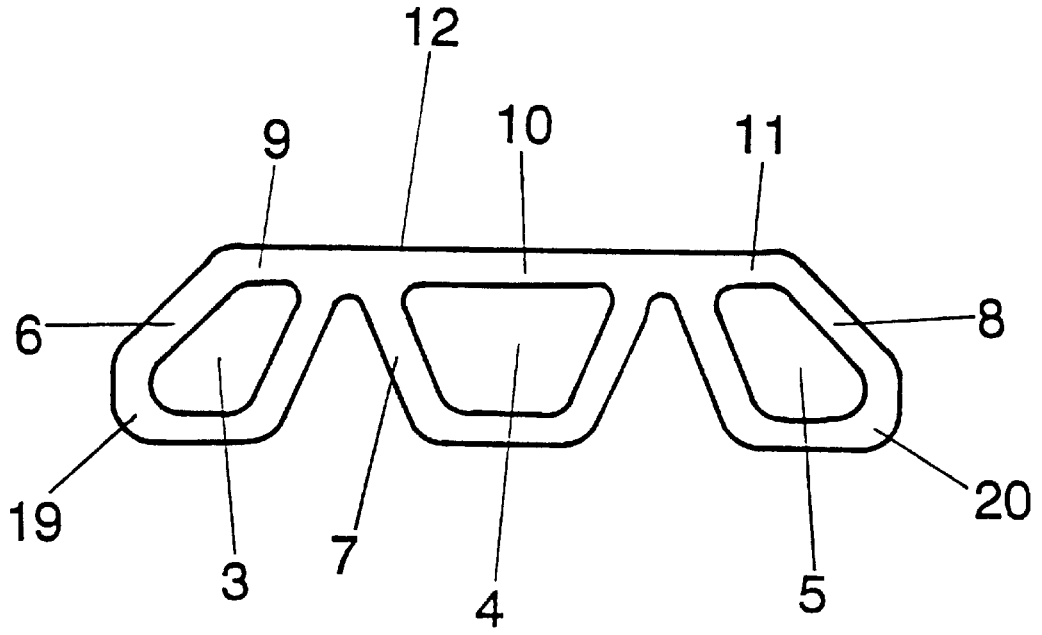

FIG. 4 shows, seen from a short side, a crosscut of a skid 1 (see FIG. 5) according to an embodiment of the invention. The skid 1 has been produced similarly to and has same basic design as the skids of FIGS. 2 and 3. The Skid 1 comprises three hollow chambers 3, 4 and 5 resulting in a yet more favourable ratio between width and height of hollow chambers 3, 4 and 5, compared to the concept of FIG. 1 and the embodiments of FIGS. 2 and 3. Advantages obtained with embodiments according to FIGS. 2 and 3 are further increased, such as reduced tendency to inner tensions at lower edges 19 and 20. Each of the hollow chambers 3, 4 and 5 is enveloped by a defining wall 6, 7 and 8 and each upper part 9, 10 and 11 of the walls 6, 7 and 8 constitutes an upper horizontal surface 12 to which the skid 1 is attached to a pallet, a container pallet or similar 2 (see FIG. 5). A dividing into three hollow chambers 3, 4 and 5 give central surface 12 a very high stability without any tendency to bend downwards and/or inwards when charged.

Figure 5:
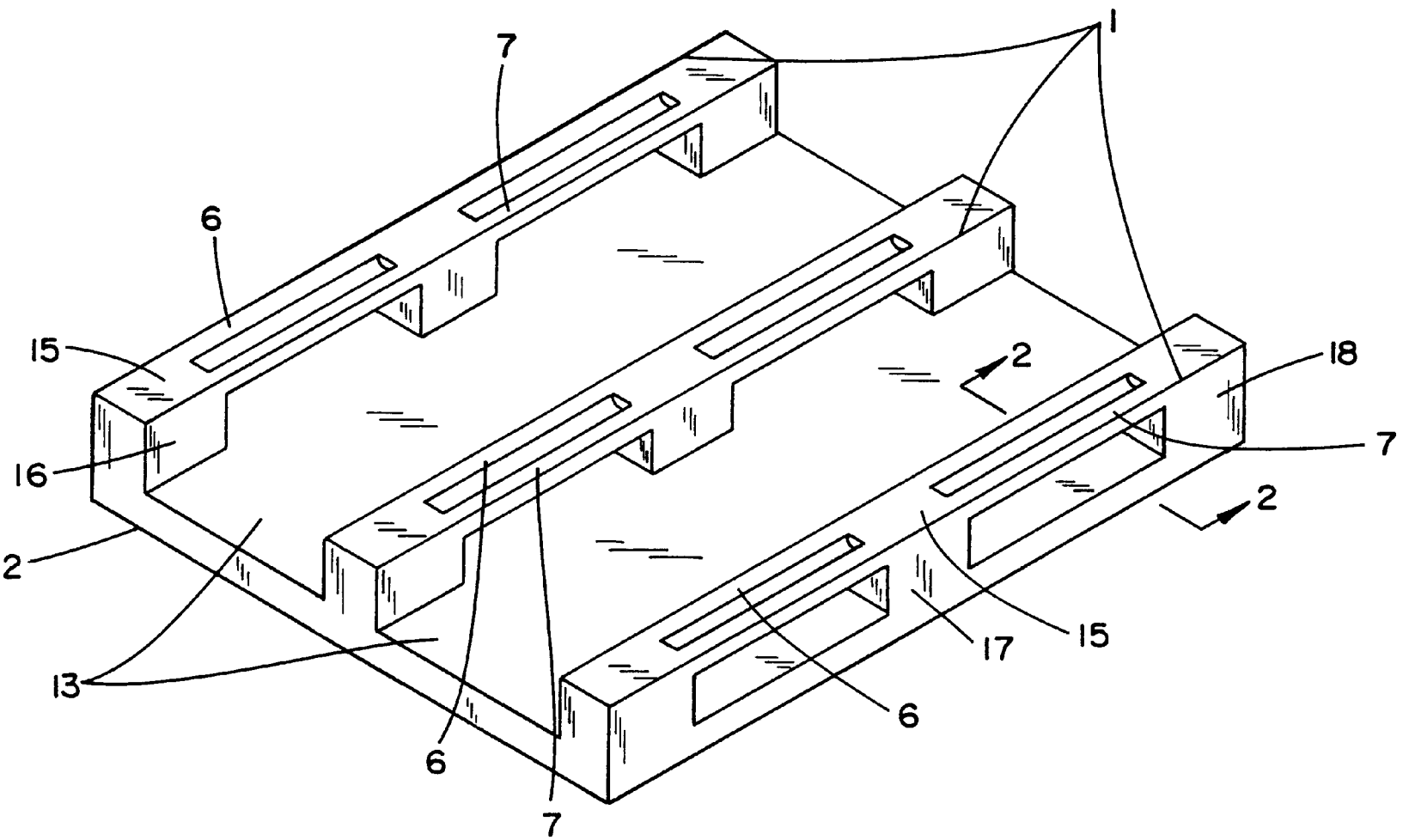
FIG. 5 shows seen from beneath a perspective view of a pallet provided with three skids according to an embodiment of the invention.

FIG. 5 show, seen from below, a perspective view of a pallet 2 provided with three skids 1 according to an embodiment of the invention. The embodiment is similar to the embodiments of FIGS. 2 and 3. Each skid 1 of the pallet 2 comprises two hollow chambers 3 and 4 (see FIGS. 2 and 3). Each skid 1 is affixed to a load carrying part 13 of the pallet 2 by means of connecting legs 16, 17 and 18 attach to an upper horizontal surface 12 (see FIGS. 2 and 3) of said skid 1. Enveloping walls 6 and 7 of the hollow chambers 3 and 4 are adjacent the legs 16, 17 and 18 downwards provided with a joining and reinforcing bar 15.

While particular embodiments of the invention have been shown, it will be understood, of course, that the invention is not limited thereto since many modifications may be made, and it is, therefore, contemplated to cover by the appended claims any such modifications as fall within the true spirit and scope of the invention.

I claim:

1. An injection molded polymeric skid and load carrying article, the injection molded polymeric skid comprising at least two hollow profiles, each hollow profile comprises two or more longitudinal substantially closed gas injection molded hollow chambers, the hollow chambers being separated from each other and separately enveloped by one or more defining walls, all portions of the walls being of an essentially even material thickness and where respective upper portions of the walls form an upper horizontal surface at which each hollow profile is attached to each other and the article via connecting legs.

2. The skid according to claim 1 wherein the defining walls are connected to each other by means of one or more joining and reinforcing profiles.

3. The skid according to claim 2, wherein the joining and reinforcing profiles are selected from the group consisting of ribs, webs, bars, and girders.

4. The skid according to claim 1 wherein the upper horizontal surface of each hollow profile is attached to a load carrying part of the article by means of one or more joining legs.

5. The skid according to claim 1 wherein the upper horizontal surface of each hollow profile is attached to a load carrying part of the article.

6. The skid according to claim 1 wherein each hollow profile is permanently attached to the article by means of gluing or welding.

7. The skid according to claim 1 wherein the skid is an integrated part of the article, whereby all parts of the article and the skid are produced as a unit in a single injection moulding.

8. The skid according to claim 1, wherein the load carrying article is pallet.

9. The skid according to claim 8, wherein the joining and reinforcing profiles are hollow.

10. The skid according to claim 8, wherein the joining and reinforcing profiles are solid.

* * * * *

UNITED STATES PATENT AND TRADEMARK OFFICE

CERTIFICATE OF CORRECTION

PATENT NO. : 5,934,638
DATED : August 10, 1999
INVENTOR(S) : Jean-Michel Provot

It is certified that error appears in the above-identified patent and that said Letters Patent is hereby corrected as shown below:

Title page,
Item [56], References Cited: insert
-- FOREIGN PATENT DOCUMENTS
FR 2 697 502 05/06/94 France WO 94/11262 05/26/94 International DE 41 28 883 03/04/93 Germany --

Signed and Sealed this

Nineteenth Day of February, 2002

*Attest:*

*Attesting Officer*

JAMES E. ROGAN
*Director of the United States Patent and Trademark Office*